US007456560B2

(12) United States Patent
Knorr

(10) Patent No.: US 7,456,560 B2
(45) Date of Patent: Nov. 25, 2008

(54) VEHICLE HEADLIGHT BULB

(75) Inventor: Klaus-Peter Knorr, Nennslingen (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 258 days.

(21) Appl. No.: 10/588,496

(22) PCT Filed: Jan. 17, 2005

(86) PCT No.: PCT/DE2005/000058

§ 371 (c)(1),
(2), (4) Date: Aug. 4, 2006

(87) PCT Pub. No.: WO2005/076318

PCT Pub. Date: Aug. 18, 2005

(65) Prior Publication Data

US 2007/0164649 A1 Jul. 19, 2007

(30) Foreign Application Priority Data

Feb. 9, 2004 (DE) ..... 10 2004 006 438

(51) Int. Cl.
*H01K 1/46* (2006.01)
*H01J 5/48* (2006.01)
*H01J 5/50* (2006.01)

(52) U.S. Cl. ..... 313/318.01; 313/318.09; 313/48; 313/623

(58) Field of Classification Search ..... None
See application file for complete search history.

(56) References Cited

U.S. PATENT DOCUMENTS

| | | | | |
|---|---|---|---|---|
| 3,885,149 | A | 5/1975 | Wolfe et el. | |
| 4,714,858 | A | 12/1987 | Sanders et al. | |
| 4,751,421 | A | 6/1988 | Braun et al. | |
| 4,843,276 | A | 6/1989 | Jacrot | |
| 4,864,183 | A | 9/1989 | Okano et al. | |
| 6,239,539 | B1 * | 5/2001 | Mochiduki et al. ..... | 313/318.01 |

FOREIGN PATENT DOCUMENTS

| | | |
|---|---|---|
| DE | 90 10 517 | 10/1990 |
| EP | 0 235 855 | 9/1987 |
| GB | 1 334 860 | 10/1973 |

* cited by examiner

*Primary Examiner*—Ashok Patel
(74) *Attorney, Agent, or Firm*—William E. Meyer

(57) ABSTRACT

The invention relates to a vehicle headlight bulb with a bulb receptacle, a spiral wound filament (2) which is arranged inside the receptacle for the bulb (1) and a lamp base which has a metal base bushing (3) wherein the end (11) of the bulb receptacle (1), which is sealed by means of a molybdenum film seal (112, 113) is fixed. According to the invention, the metal base bushing (3) comprises at least one molded tab (32) which lies adjacent to the sealed end (11) of the bulb receptacle (1), in the overlapping area of the molybdenum films (112, 113), with current supply wires (23, 24) which protrude from the bulb receptacle and which are connected thereto, in order to reduce thermal load in the above-mentioned overlapping area during operation of the bulb.

4 Claims, 7 Drawing Sheets

VEHICLE HEADLIGHT BULB

Figure 1:
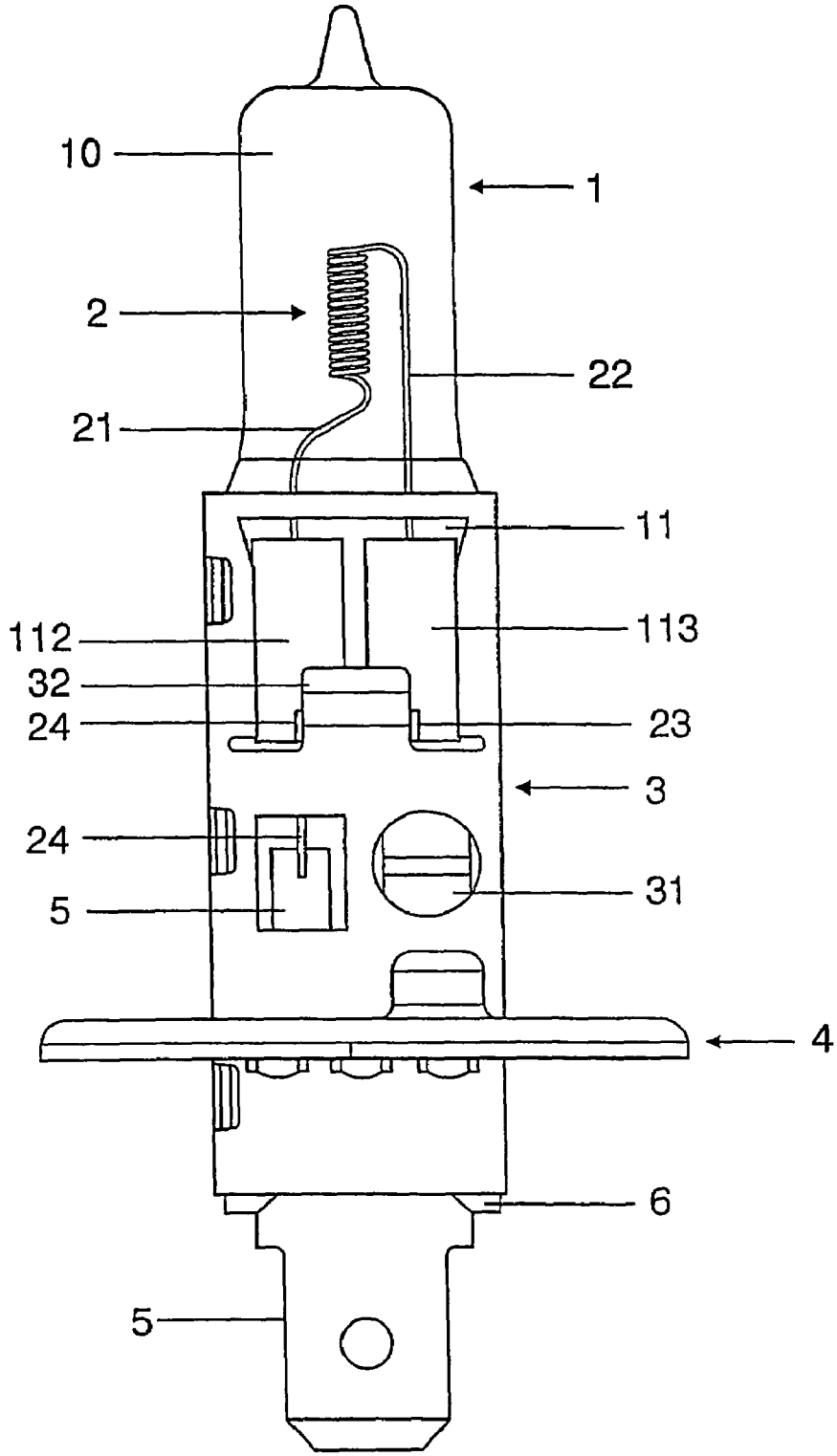

The invention relates to a vehicle headlamp in accordance with the precharacterizing clause of patent claim 1.

I. PRIOR ART

Such a vehicle headlamp is disclosed, for example, in the laid-open specification EP 0 235 855 A1. This specification describes a halogen incandescent lamp of the H1 type, which is used in motor vehicle headlights for producing the lower beam or upper beam. This halogen incandescent lamp has a lamp vessel having an incandescent filament arranged therein and a lamp base, which has a metallic sleeve in which a sealed end of the lamp vessel is fixed. The power supply lines of the incandescent filament which protrude out of the lamp vessel are welded to welding lugs integrally formed on the base sleeve. In addition, the welding lugs are also used for dissipating the heat produced by the incandescent filament away from the sealed end of the lamp vessel.

II. DESCRIPTION OF THE INVENTION

It is the object of the invention to provide a generic vehicle headlamp having improved heat dissipation in the region of the sealed end of the lamp vessel. In particular, the thermal load on the sealed end of the lamp vessel should be reduced in the region of the molybdenum foil fuse seals.

This object is achieved according to the invention by the features of patent claim 1. Particularly advantageous embodiments of the invention are described in the dependent patent claims.

The vehicle headlamp according to the invention has a lamp vessel, a luminous means arranged within the lamp vessel and a lamp base, the lamp vessel having a sealed end, which has at least one molybdenum foil seal, which comprises at least one molybdenum foil and a power supply wire, which overlaps and is connected to said molybdenum foil and protrudes out of the sealed end of the lamp vessel, the lamp base having a metallic base sleeve, in which the sealed end of the lamp vessel is fixed and which has at least one aperture in the region of the sealed end. According to the invention, the metallic base sleeve is equipped with at least one integrally formed tab, which protrudes into the aperture of the metallic base sleeve and bears against the sealed end of the lamp vessel in the region of overlap between the at least one molybdenum foil and the power supply wire.

As a result, the thermal load on the sealed end of the lamp vessel is reduced in the region of the molybdenum foil fuse seal and in particular in the region of overlap between the at least one molybdenum foil and the power supply wire during lamp operation. The abovementioned tab which is integrally formed on the metallic base sleeve allows for improved dissipation of heat away from the sealed end of the lamp vessel. In particular, it is therefore possible for the temperature in the abovementioned region of overlap between the molybdenum foil and the power supply wire to be reduced during lamp operation and for the risk of the occurrence of oxidation and cracks in the region of the connection between the molybdenum foil and the power supply wire, which is preferably formed by welding, to be reduced. The life of the lamp is thereby extended.

In order to achieve optimum cooling of the joint between the abovementioned molybdenum foil and the power supply wire, the at least one tab, which is integrally formed on the metallic base sleeve, advantageously bears against the sealed end of the lamp vessel in the region of this joint, which is preferably formed by welding.

The metallic base sleeve of the vehicle headlamp according to the invention preferably consists of stainless steel or brass since these metals have good processing properties and a high degree of corrosion resistance.

III. DESCRIPTION OF THE PREFERRED EXEMPLARY EMBODIMENT

Figure 2:
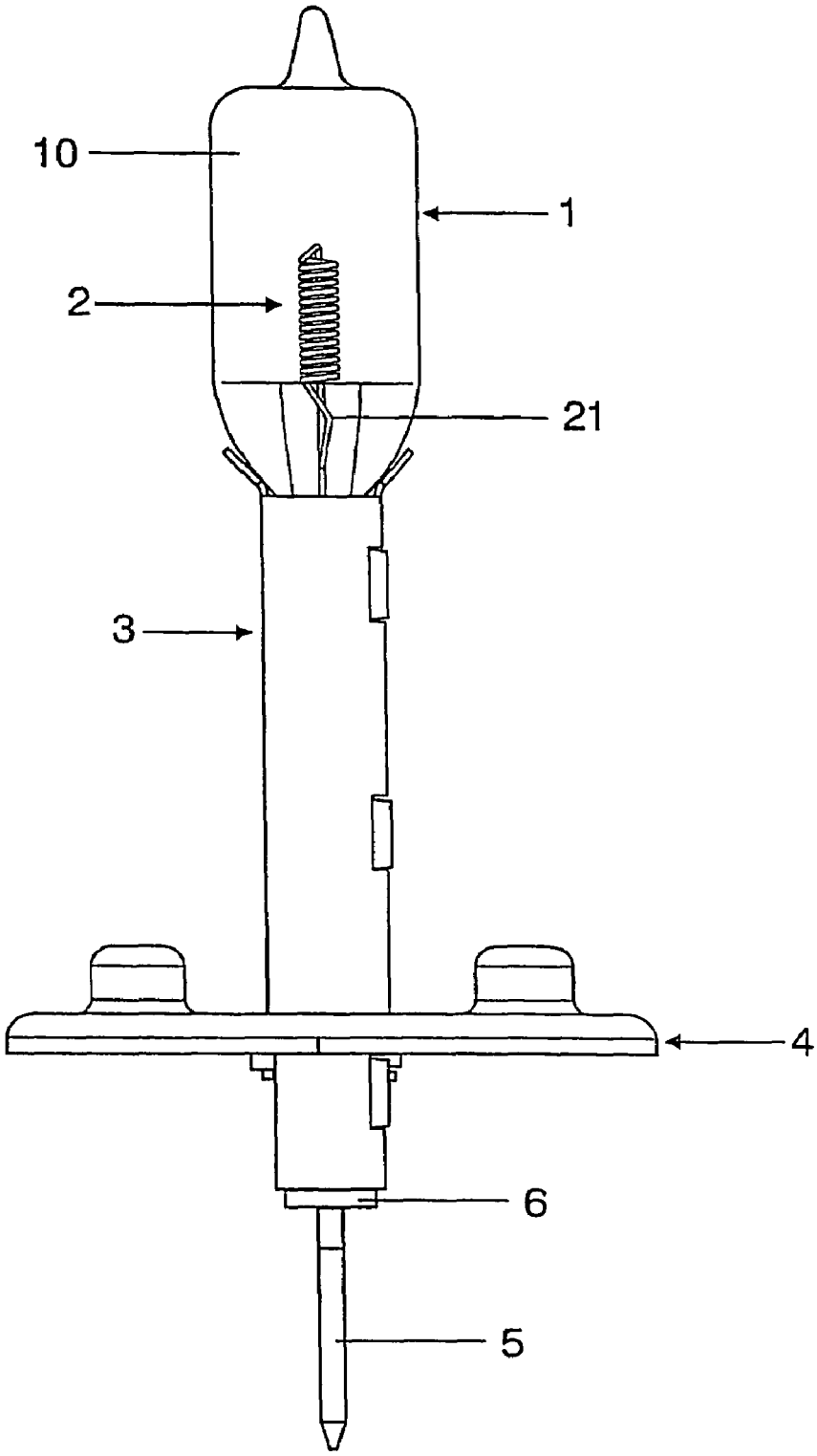
Figure 3:
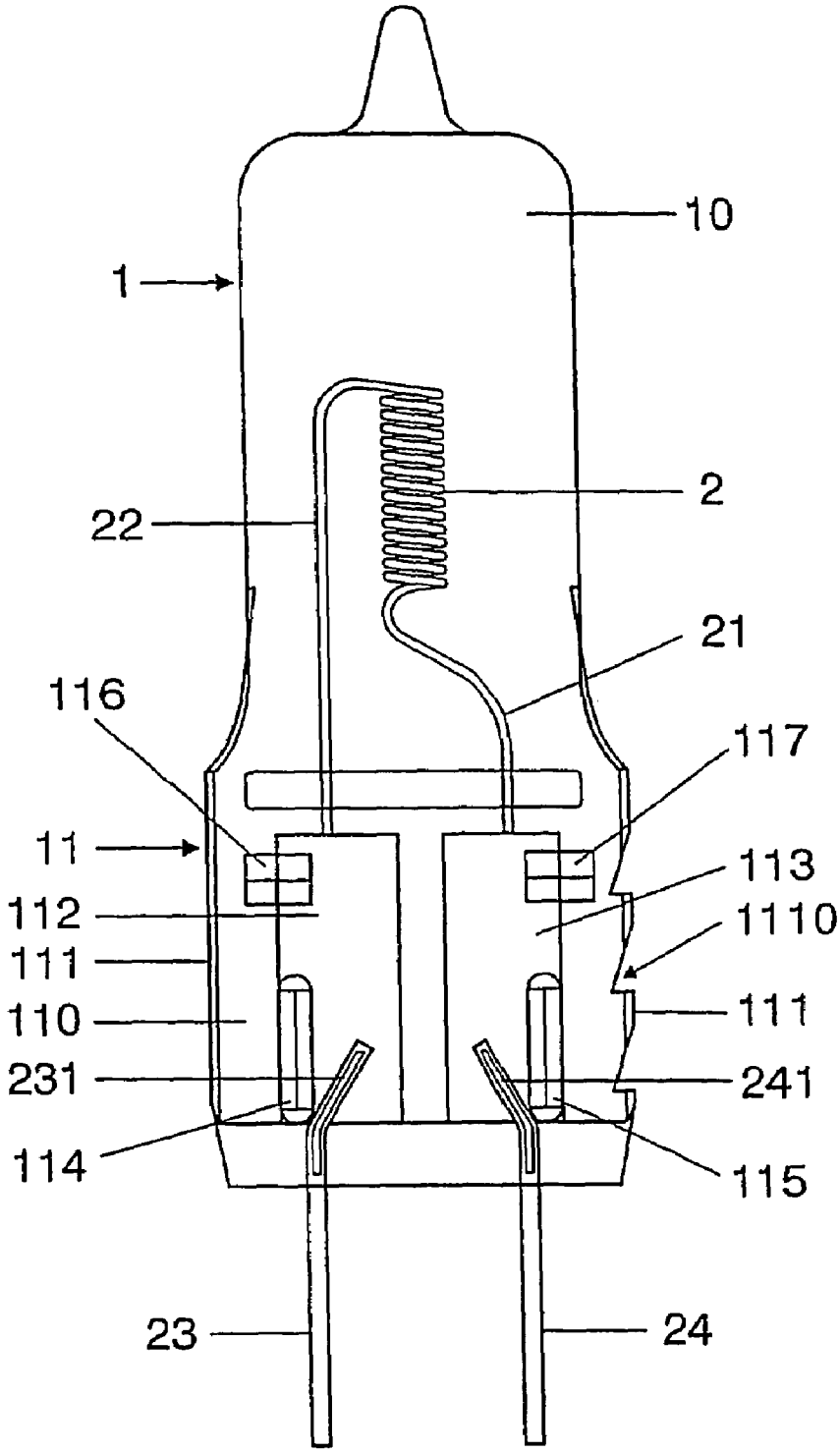
Figure 4:
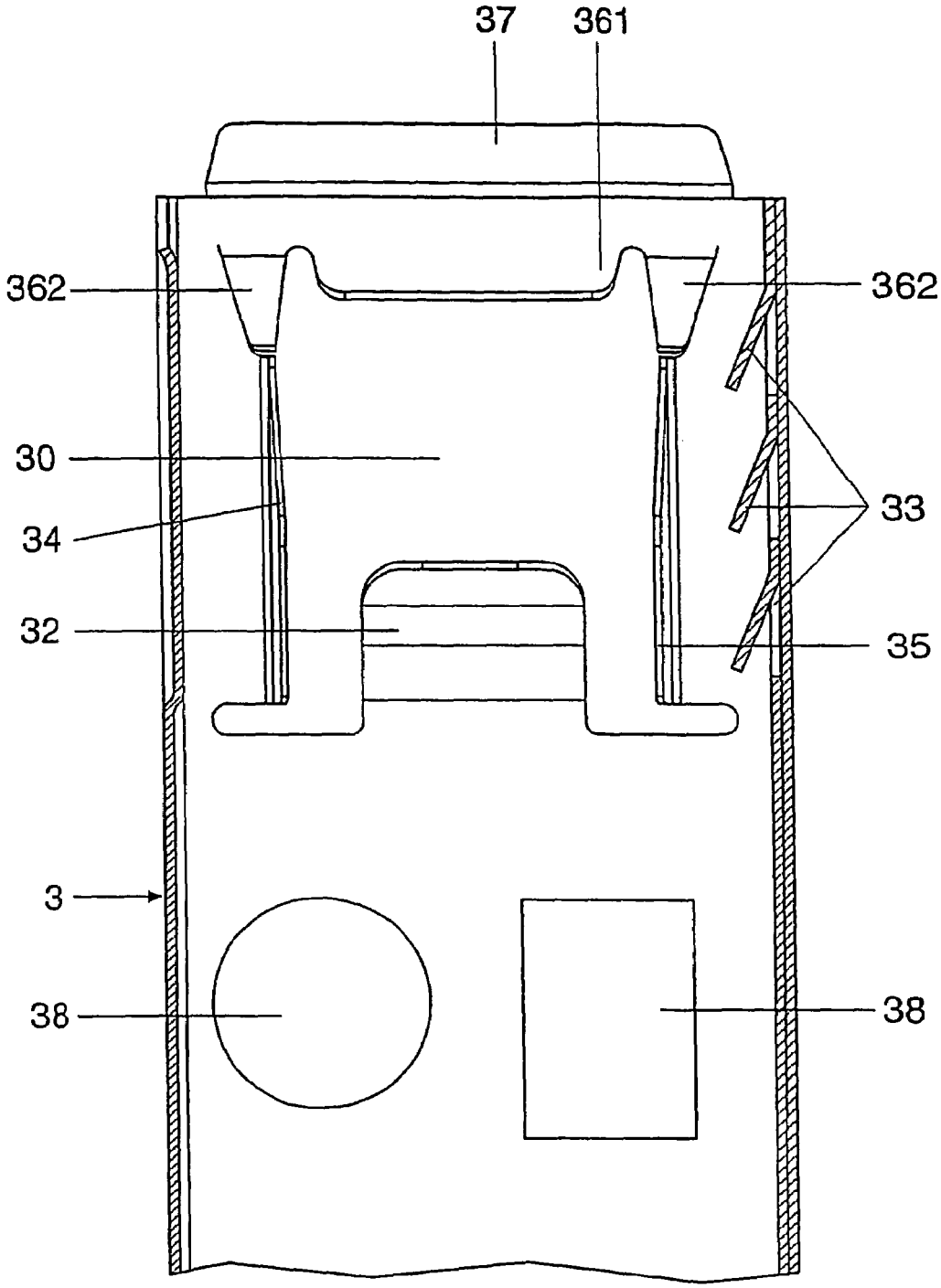
Figure 5:
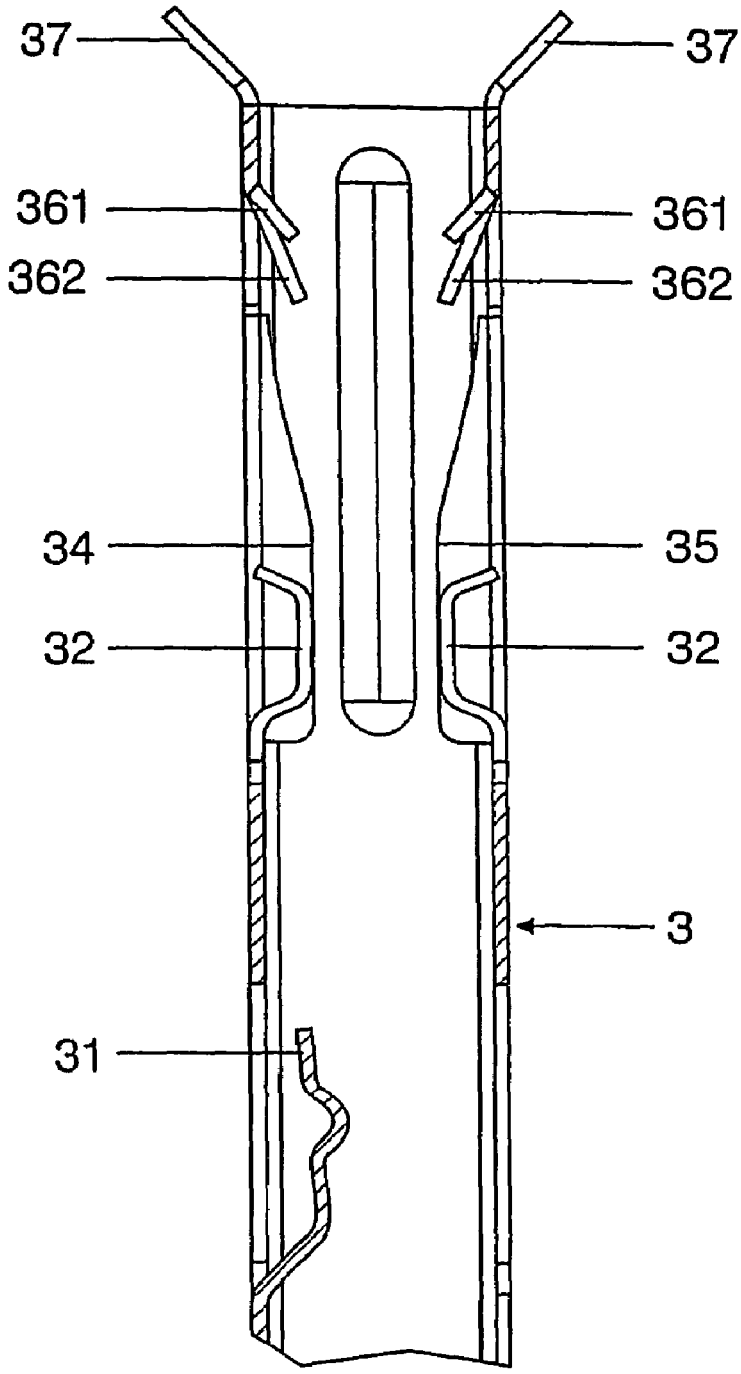
Figure 6:
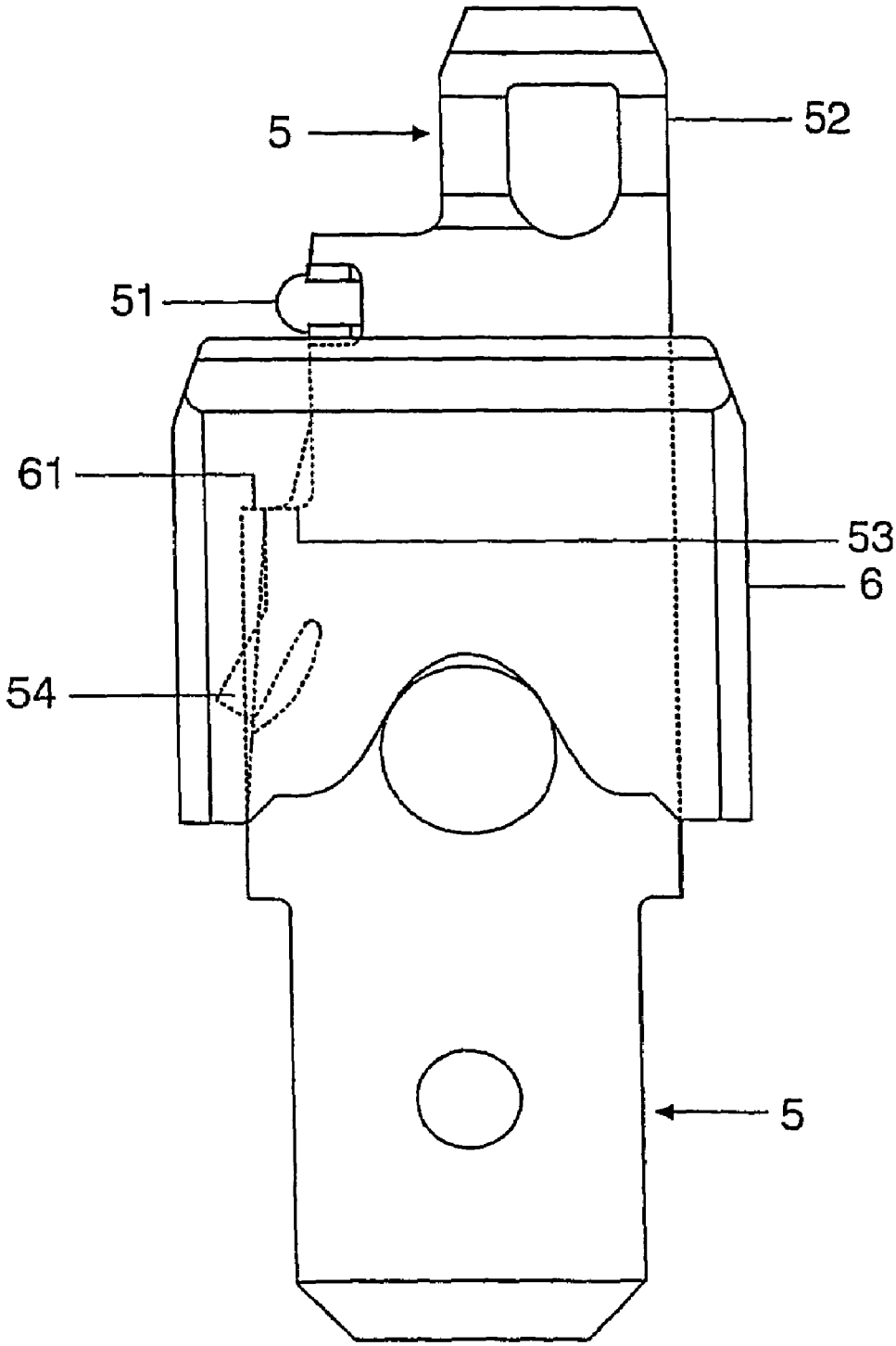
Figure 7:
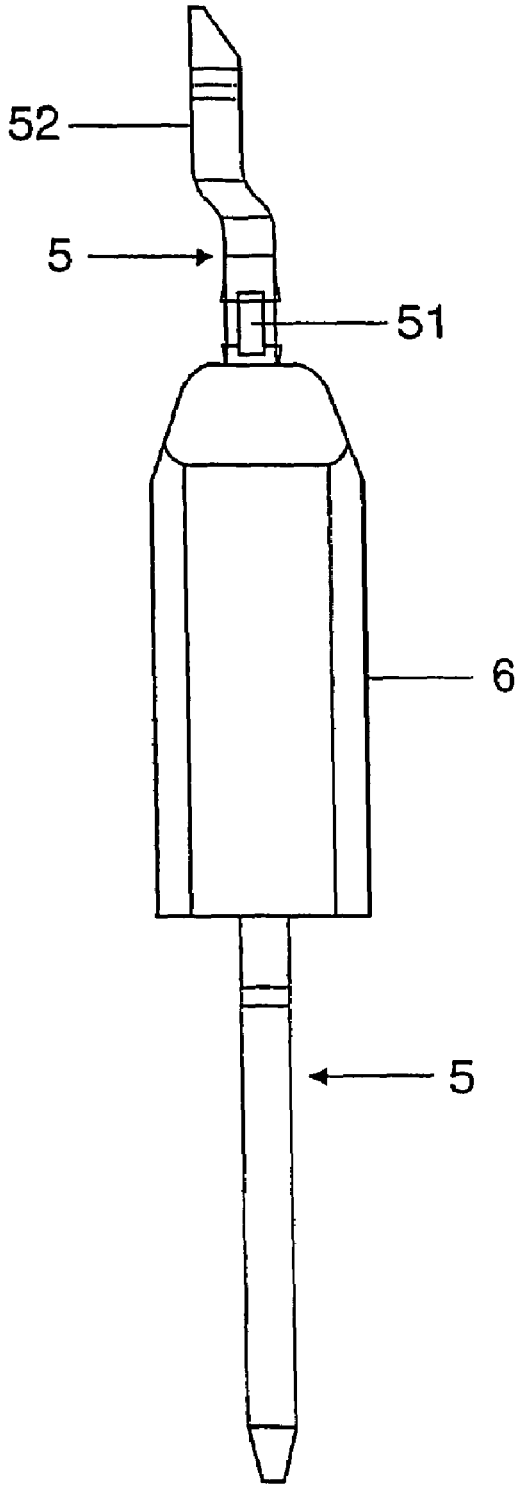

The invention will be explained in more detail below with reference to a preferred exemplary embodiment. In the drawings:

FIG. 1 shows a side view of a vehicle headlamp in accordance with the preferred exemplary embodiment of the invention, FIG. 2 shows the vehicle headlamp depicted in FIG. 1 in a side view which is rotated through 90° with respect to the lamp axis in comparison with the side view in FIG. 1, FIG. 3 shows a side view of the lamp vessel of the vehicle headlamp depicted in FIG. 1, FIG. 4 shows a partially sectioned side view of a detail of the base sleeve of the vehicle headlamp depicted in FIG. 1, FIG. 5 shows the detail depicted in FIG. 4 of the base sleeve in a sectioned side view which is rotated through 90° in comparison with that in FIG. 4, FIG. 6 shows a side view of the contact lug and the base insulator of the vehicle headlamp depicted in FIG. 1, and FIG. 7 shows the contact lug depicted in FIG. 6 with the base insulator in a side view rotated through 90° in comparison with that in FIG. 6.

The preferred exemplary embodiment of the invention depicted in FIGS. 1 to 7 is a halogen incandescent lamp of the H1 lamp type, which can be used in vehicle headlights for producing the lower beam, the upper beam or the foglight.

This lamp has an essentially cylindrical lamp vessel 1 consisting of quartz glass, which has an essentially circular-cylindrical interior 10 and is closed at one end by means of a pinch seal 11. An axially aligned incandescent filament 2 is arranged in the interior 10 of the lamp vessel 1, and its ends are each welded to a molybdenum foil 112, 113 via an inner power supply line 21, 22 consisting of tungsten. The molybdenum foils 112, 113 are part of the pinch seal 11, which is in the form of a molybdenum foil seal. They are embedded in a gas-tight manner in the pinch base 11. Two power supply wires 23, 24 consisting of molybdenum protrude out of the pinch base 11, are each welded to one of the molybdenum foils 112 and 113, respectively, and are used for supplying power to the incandescent filament 2. The pinch base 11 is fixed in a metallic base sleeve 3 with a clamping fit. The base sleeve 3 has in each case one aperture 30 in the region of the pinch base 11 at two opposite side walls such that the broad sides 110 of the pinch base 11 are essentially uncovered by the base sleeve 3 in the region of the molybdenum foils 112, 113 in order not to impede the output of heat from the broad sides 110 of the pinch base 11. The base sleeve 3 essentially surrounds only the narrow end sides 111 of the pinch base 11. The base sleeve 3 has two tabs 32, which each extend into one of the apertures 30 and bear against the pinch base 11 in the region of overlap between the power supply wires 23, 24 and the molybdenum foils 112, 113. These tabs 32 are each integrally formed on one edge of the respective aperture 30 in the base sleeve 3. They are used as cooling plates for reducing the thermal load on the welded joints between the power supply wires 23, 24 and the molybdenum foils 112, 113.

The power supply wire 23 is electrically conductively connected to a contact tab 31, which is integrally formed on the base sleeve 3 and points into the interior of the base sleeve 3. The base sleeve 3 and therefore also the power supply wire 23 and the inner power supply line 22 are at ground potential, for example, during lamp operation. For this purpose, the contact lug 5, which is electrically conductively connected to the power supply wire 24 and is electrically insulated from the base sleeve 3 by means of the base insulator 6 consisting of ceramic, forms the opposing electrical pole. An annular base flange 4 is fixed to the base sleeve 3 and is used for aligning and fitting the H1 lamp in a motor vehicle headlight. The lamp base comprises the base flange 4, the base sleeve 3, the base insulator 6 and the contact lug 5. The base sleeve 3 preferably consists of stainless steel or brass. The base flange 4 consists of nickel silver, and the contact lug 5 consists of stainless steel. FIGS. 2 to 7 illustrate details of the lamp base and the lamp vessel 1.

FIG. 3 shows details of the lamp vessel 1 and the pinch seal 11. The pinch seal 11 has two mutually opposite broad sides 110 and two mutually opposite narrow end sides 111. It is essentially in the form of a parallelepiped. The molybdenum foils 112, 113 welded to the inner power supply lines 21, 22 and the power supply wires 23, 24 are embedded in the pinch base 11 in a gas-tight manner. The bent-back ends 231, 241 of the power supply wires 23, 24 overlap the molybdenum foils 112 and 113 and are welded to the molybdenum foils 112 and 113, respectively. In this region of overlap, the two tabs 32 bear against the broad sides 110 of the pinch seal 11 such that the pinch seal 11 is arranged between the two tabs 32 with a clamping fit. One of the two narrow end sides 111 of the pinch seal 11 is provided with a saw-tooth-shaped profile 1110 which extends in the longitudinal direction of the lamp or the lamp vessel 1. This profile 1110 forms a latching connection together with at least one of the three latching tabs 33, which are depicted in FIG. 4, are integrally formed on the base sleeve 3 and extend into the interior of the base sleeve 3. Once the pinch seal 11 has been inserted into the base sleeve 3, the latching tabs 33 latch in behind the teeth of the saw-tooth-shaped profile 1110 and thus prevent the pinch seal 11 from being capable of being removed from the base sleeve 3 again. The latching tabs 33 are of resilient design such that the narrow end sides 111 of the pinch seal 11 are arranged in the base sleeve 3 likewise with a clamping fit. Each of the two broad sides 110 of the pinch seal 11 is equipped with an integrally formed pair of guide webs 114, 115, which extend in the longitudinal direction of the lamp or the lamp vessel 1 and each interact with a pair of tabs 34, 35 which are integrally formed on the base sleeve 3 in order to allow for a precise alignment of the lamp vessel 1 with respect to the base sleeve 3. The tabs 34, 35 are each integrally formed on two opposite edges, which run in the longitudinal direction of the lamp, of the apertures 30 of the base sleeve 3, which apertures are arranged in the region of the pinch seal 11, and bear with a clamping fit against the broad sides 110 of the pinch seal 11. The guide webs 114, 115 act as a stop for the free ends of the tabs 34, 35. Two pairs of knobs 116, 117, which are integrally formed on the broad sides 110 of the pinch seal 11, interact with in each case one guide tab 361, which are integrally formed on the metallic base sleeve 3 and extend into the aperture 30, in order to ensure a precise alignment and guidance of the pinch seal 11 in the base sleeve 3.

Details of the base sleeve 3 are depicted in FIGS. 4 and 5. The base sleeve 3 also has four further fixing tabs 362, which bear against the broad sides of the pinch seal 11 with a clamping fit in the region of the apertures 30. In addition, the base sleeve 3 has two integrally formed shielding plates 37, which shield the lamp base from the light emitted by the incandescent filament 2. The essentially parallelepipedal base sleeve 3 has in each case two cutouts 38 on two-opposite sides, which cutouts are used for welding the power supply wires 23, 24 to the contact tab 31 or the contact lug 5.

FIGS. 6 and 7 illustrate details of the contact lug 5 and the base insulator 6. The contact lug 5 is fixed in the hollow base insulator 6 with a clamping fit. The two ends of the contact lug 5 protrude out of the base insulator 6. A relief 61 is located in the interior of the base insulator 6, and a shoulder 53 of the contact lug 5 rests on said relief. The welding tab 52 protruding out of the base insulator 6 is provided with a flattened section 51 or a corner molding, which interacts with the shoulder 53 and the relief 61 in order to ensure the clamping fit of the contact lug 5 in the base insulator 6. The welding tab 52 of the contact lug 5 is welded to the power supply wire 24 once the structural unit comprising the base insulator 6 and the contact lug 5 has been inserted into the base sleeve 3. In order to anchor the contact lug 5 in the base insulator 6, the contact lug 5 has a spring tab 54, which is integrally formed on a side edge, is spread apart from said side edge and ensures a clamping fit of the contact lug 5 in the base insulator 6.

The invention claimed is:

1. A vehicle headlamp having a lamp vessel, a luminous means (2) arranged therein and a lamp base, the lamp vessel (1) having a sealed end (11), which has at least one molybdenum foil seal, which comprises at least one molybdenum foil (112) and a power supply wire (24), which overlaps and is connected to said molybdenum foil and protrudes out of the sealed end (11) of the lamp vessel (1), the lamp base having a metallic base sleeve (3), in which the sealed end (11) of the lamp vessel (1) is fixed, the base sleeve (3) having at least one aperture (30), which is arranged in the region of the sealed end (11) of the lamp vessel (1), characterized in that the metallic base sleeve (3) has at least one integrally formed tab (32), which protrudes into the aperture (30) and bears against the sealed end (11) of the lamp vessel (1) in the region of overlap between the at least one molybdenum foil (112) and the power supply wire (24), and said tab (32) is constructed as a cooling plate and the free end of said tab (32) is located closer to the luminous means (2) than the end of said tab (32) which is connected to the base sleeve (3).

2. The vehicle headlamp as claimed in claim 1, characterized in that the at least one molybdenum foil (112) and the power supply wire (24) which overlaps it are connected to one another by means of welding, and the at least one tab (32) which is integrally formed on the metallic base sleeve (3) bears against the sealed end (11) of the lamp vessel (1) in the region of the welding.

3. The vehicle headlamp as claimed in claim 1, characterized in that the metallic base sleeve (3) consists of stainless steel.

4. The vehicle headlamp as claimed in claim 1, characterized in that the metallic base sleeve (3) consists of brass.

* * * * *